US011465416B2

(12) United States Patent
Hamano

(10) Patent No.: US 11,465,416 B2
(45) Date of Patent: Oct. 11, 2022

(54) INKJET HEAD AND INKJET RECORDING DEVICE

(71) Applicant: Konica Minolta, Inc., Tokyo (JP)

(72) Inventor: Hikaru Hamano, Saitama (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 17/252,416

(22) PCT Filed: Jun. 15, 2018

(86) PCT No.: PCT/JP2018/022893
§ 371 (c)(1),
(2) Date: Dec. 15, 2020

(87) PCT Pub. No.: WO2019/239576
PCT Pub. Date: Dec. 19, 2019

(65) Prior Publication Data
US 2021/0252864 A1 Aug. 19, 2021

(51) Int. Cl.
*B41J 2/14* (2006.01)

(52) U.S. Cl.
CPC ..... *B41J 2/14201* (2013.01)

(58) Field of Classification Search
CPC ..... B41J 2/14201; B41J 2002/14467; B41J 2202/20; B41J 2202/21; B41J 2/14209; B41J 2/18; B41J 2/19
See application file for complete search history.

(56) References Cited

FOREIGN PATENT DOCUMENTS

| | | | | |
|---|---|---|---|---|
| JP | 20110520671 | A | 7/2011 | |
| WO | 2018043090 | A1 | 3/2018 | |
| WO | WO-2018043090 | A1 * | 3/2018 | ..... B41J 2/14201 |

OTHER PUBLICATIONS

IP.com search (Year: 2021).*
International Preliminary Report on Patentability with Written Opinion of the International Searching Authority; International Application No. PCT/JP2018/022893; dated Dec. 15, 2020; 14 pages.
International Search Report for International Application No. PCT/JP2018/022893; dated Jul. 17, 2018.
JPO Notice of Reasons of Refusal for corresponding JP Application No. 2020-525055; dated Oct. 26, 2021.

* cited by examiner

*Primary Examiner* — Lisa Solomon
(74) *Attorney, Agent, or Firm* — Cantor Colburn LLP

(57) ABSTRACT

An inkjet head may include the following. A plurality of ink emitters, each including, an ink storage, a pressure changer which changes pressure in the ink stored in the ink storage, a nozzle which is connected to the ink storage and which emits ink according to a change in pressure in the ink in the ink storage, a plurality of precedent stage individual discharge flow paths which are connected to one ink storage and through which ink discharged without being supplied from the ink storage to the nozzle passes, and a subsequent stage individual discharge flow path to which, the plurality of precedent stage individual discharge flow paths join. A common discharge flow path may be connected to the plurality of subsequent stages individual discharge flow paths included in the plurality of ink emitters, and the ink which passes through the plurality of subsequent stage individual discharge flow paths flows.

12 Claims, 8 Drawing Sheets

FIG.9

| | STRUCTURE OF INDIVIDUAL DISCHARGE FLOW PATH | SHAPE OF FLOW PATH | | LENGTH OF FIRST PRECEDENT STAGE INDIVIDUAL DISCHARGE FLOW PATH [mm] | LENGTH OF SECOND PRECEDENT STAGE INDIVIDUAL DISCHARGE FLOW PATH [mm] | LENGTH OF SUBSEQUENT STAGE INDIVIDUAL DISCHARGE FLOW PATH [mm] | OCCUPYING AREA OF INDIVIDUAL DISCHARGE FLOW PATH [mm2] | PRESSURE LOSS (RATIO WITH RELATION TO COMPARATIVE EXAMPLE 1) | SIZE OF BUBBLES AND FOREIGN SUBSTANCES WHICH CAN BE DISCHARGED [mm] |
|---|---|---|---|---|---|---|---|---|---|
| | | WIDTH [mm] | DEPTH [mm] | | | | | | |
| COMPARATIVE EXAMPLE 1 | FIG.10A | 0.05 | 0.05 | 1.5 | 1.5 | — | 0.15 | 1.00 | 0.05 |
| COMPARATIVE EXAMPLE 2 | FIG.10A | 0.06 | 0.06 | 1.5 | 1.5 | — | 0.18 | 0.48 | 0.06 |
| COMPARATIVE EXAMPLE 3 | FIG.10A | 0.06 | 0.06 | 1.7 | 1.7 | — | 0.20 | 0.55 | 0.06 |
| EXAMPLE 1 | FIG.11 | 0.06 | 0.06 | 0.7 | 0.7 | 1.1 | 0.15 | 0.93 | 0.06 |
| EXAMPLE 2 | FIG.11 | 0.07 | 0.07 | 0.7 | 0.7 | 1.1 | 0.18 | 0.50 | 0.07 |

INKJET HEAD AND INKJET RECORDING DEVICE

CROSS REFERENCE TO RELATED APPLICATIONS

This is the U.S. national stage of application No. PCT/JP2018/022893, filed on Jun. 15, 2018. Priority is claimed and the disclosure of which is also incorporated herein by reference.

TECHNICAL FIELD

The present invention relates to an inkjet head and an inkjet recording device.

BACKGROUND ART

Conventionally, there is an inkjet recording device in which ink is discharged from a plurality of nozzles provided on an inkjet head and the ink is landed on a predetermined position to form an image. The inkjet head in the inkjet recording device is provided with the following to correspond with each of the plurality of nozzles, an ink storage which stores ink, and a pressure changer which changes pressure on the ink in the ink storage. The ink is discharged from the nozzle connected to the ink storage in response to change of the pressure on the ink in the ink storage.

When bubbles and foreign substances are mixed in the ink storage of the inkjet head, pressure is not properly applied to the ink. This causes discharge failure of ink from the nozzle and decrease in image quality. Therefore, conventionally, there is a technique to connect each of the plurality of ink storages corresponding to the plurality of nozzles with an individual discharge flow path and then to a common discharge flow path, and some of the ink supplied to the ink storage is discharged outside the inkjet head together with the bubbles and the foreign substances through the individual discharge flow path and the common discharge flow path. According to such technique, the plurality of individual discharge flow paths are connected to the one ink storage and the bubbles and the foreign substances can be more easily discharged (for example, Patent Literature 1).

According to the inkjet head with the above configuration, if the pressure wave in response to the change of the pressure on the ink in the ink storage transmits to any other ink emitter through the common discharge flow path, the desired pressure cannot be applied to the ink in the ink emitter and the characteristics of ink emission changes, causing decrease in the image quality. Therefore, the individual discharge flow path is made longer or the cross-section area is made smaller to increase the pressure loss in the ink in the individual discharge flow path in order to make it difficult for the pressure wave entering the individual discharge flow path to be transmitted to the common discharge flow path.

CITATION LIST

Patent Literature

Patent Literature 1: JP 2011-520671 A

SUMMARY

Technical Problem

However, lately, in the inkjet head, the apparatus is becoming smaller and the array of the nozzles is becoming denser. Since there is a limit to the region where the individual discharge flow path can be positioned, there is not much freedom to make the individual discharge flow path longer in the inkjet head in which the plurality of individual discharge flow paths are connected to the one ink storage. Therefore, the pressure loss cannot be increased sufficiently with the method of making the individual discharge flow path longer, and it is difficult to effectively suppress the decrease in image quality due to the pressure waves transmitting.

On the other hand, if the pressure loss is increased by making the cross-section area of the individual discharge flow path smaller, the bubbles and the foreign substances which can be discharged become smaller, and therefore, the decrease in the image quality due to the bubbles and the foreign substances in the ink storage becomes clearer.

As described above, according to the inkjet head in which a plurality of individual discharge flow paths are connected to one ink storage, there is a problem that it is not easy to effectively suppress decrease in the image quality.

A purpose of the present invention is to provide an inkjet head and an inkjet recording device in which the decrease in image quality can be effectively suppressed.

Solution to Problem

In order to achieve the above purposes, aspect 1 of the invention describes an inkjet head including: a plurality of ink emitters, each including, an ink storage which stores ink; a pressure changer which changes pressure in the ink stored in the ink storage; a nozzle which is connected to the ink storage and which emits ink according to a change in the pressure in the ink in the ink storage; a plurality of precedent stage individual discharge flow paths which are connected to one ink storage and through which ink discharged without being supplied from the ink storage to the nozzle passes; and a subsequent stage individual discharge flow path to which the plurality of precedent stage individual discharge flow paths join, and a common discharge flow path which is connected to the plurality of subsequent stage individual discharge flow paths included in the plurality of ink emitters, and in which the ink which passes through the plurality of subsequent stage individual discharge flow paths flows.

Aspect 2 of the invention describes the inkjet head according to aspect 1, wherein each of the plurality of precedent stage individual discharge flow paths has a length different from another precedent stage individual discharge flow path among the plurality of precedent stage individual discharge flow paths.

Aspect 3 of the invention describes the inkjet head according to aspect 2, wherein the pressure loss for each unit of a length is small in the plurality of precedent stage individual discharge flow paths as the precedent stage individual discharge flow path becomes longer.

Aspect 4 of the invention describes the inkjet head according to any one of aspects 1 to 3, wherein the pressure loss of the ink in each of the plurality of precedent stage individual discharge flow paths is different from the pressure loss of the ink in another precedent stage individual discharge flow path among the plurality of precedent stage individual discharge flow paths.

Aspect 5 of the invention describes the inkjet head according to any one of aspects 1 to 4, wherein the pressure loss of the ink in the subsequent stage individual discharge flow path is larger than the pressure loss of the ink in the plurality of precedent stage individual discharge flow paths.

Aspect 6 of the invention describes the inkjet head according to aspect 5, wherein a minimum value of a cross-section area vertical in an ink discharge direction in the subsequent stage individual discharge flow path is equal to or more than a minimum value of a cross-section area vertical to an ink discharge direction in each of the plurality of precedent stage individual discharge flow paths.

Aspect 7 of the invention describes the inkjet head according to any one of aspects 1 to 6, wherein each of the plurality of ink emitters include two precedent stage individual discharge flow paths, and the two precedent stage individual discharge flow paths are connected to the ink storage in a direction opposite to each other.

Aspect 8 of the invention describes the inkjet head according to any one of aspects 1 to 7, wherein, each of the plurality of ink emitters include two precedent stage individual discharge flow paths, the plurality of nozzles included in the plurality of ink emitters are arranged along a predetermined direction, and regarding the two precedent stage individual discharge flow paths connected to each nozzle other than a nozzle at a predetermined end among the plurality of nozzles, only one of the precedent stage individual discharge flow paths passes between adjacent nozzles viewed from a side in an ink discharge direction from the nozzle.

Further, in order to achieve the above purposes, aspect 9 of the invention describes an inkjet recording device including the inkjet head according to any one of aspects 1 to 8.

Advantageous Effects of Invention

According to the present invention, it is possible to achieve the effect of more effectively suppressing the decrease in image quality.

BRIEF DESCRIPTION OF DRAWINGS

FIG. 9 is a diagram showing a condition and result of simulation performed to confirm an effect of an embodiment of the present invention.

DESCRIPTION OF EMBODIMENTS

Embodiments regarding the inkjet head and the inkjet recording device according to the present invention are described based on the diagrams.

Figure 1:
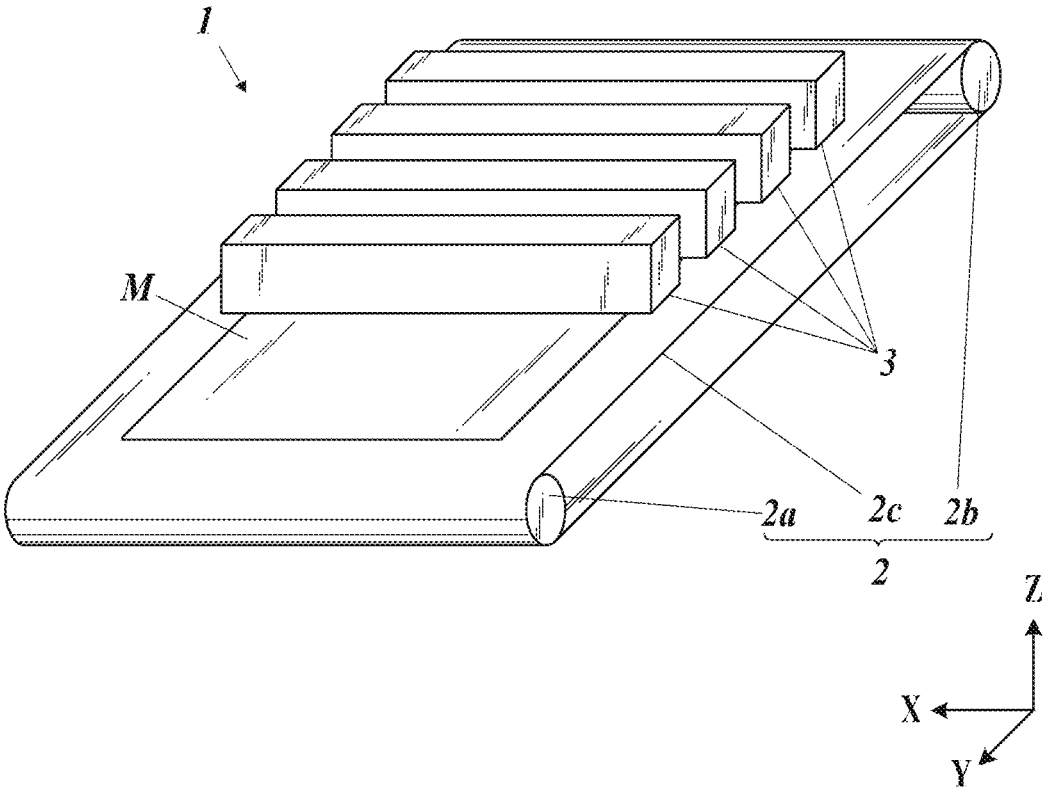
FIG. 1 is a diagram showing an outline of a configuration of the inkjet recording device.

FIG. 1 is a diagram showing a schematic configuration of the inkjet recording device 1 according to an embodiment of the present invention.

The inkjet recording device 1 includes a conveyor 2 and a head unit 3.

The conveyor 2 includes a conveying belt 2*c* in a ring shape supported from the inner side by two conveying rollers 2*a* and 2*b* which rotate around a rotating axis which extends in an X-direction of FIG. 1. In the conveyor 2, in a state with a recording medium M placed on a conveying surface of the conveying belt 2*c*, the conveying roller 2*a* rotates in response to operation of a conveying motor (not shown), and the conveying belt 2*c* moves in a rotation. With this, the conveyor 2 conveys the recording medium M in a moving direction of the conveying belt 2*c* (conveying direction; Y-direction in FIG. 1).

The recording medium M can be flat sheets of paper cut in a certain dimension. The recording medium M is supplied on a conveying belt 2*c* by a sheet feeding device (not shown) and after ink is emitted from the head unit 3 and the image is recorded, the recording medium M is discharged from the conveying belt 2*c* to a predetermined sheet discharger. A rolled sheet of paper can be used as the recording medium M. Moreover, as the recording medium M, other than paper such as normal paper or coated paper, various media in which ink landed on the surface can be fixed can be used, for example, fabric and resin in a sheet.

The head unit 3 discharges ink at a suitable timing based on image data onto the recording medium M conveyed by the conveyor 2 and records the image. According to the inkjet recording device 1 of the present embodiment, four head units 3 each corresponding to ink in four colors which are yellow (Y), magenta (M), cyan (C), and black (K) are arranged to be aligned with a predetermined interval in order from an upstream side of the conveying direction of the recording medium M, the order being Y, M, C, K. The number of head units 3 can be three or less or five or more.

Figure 2:
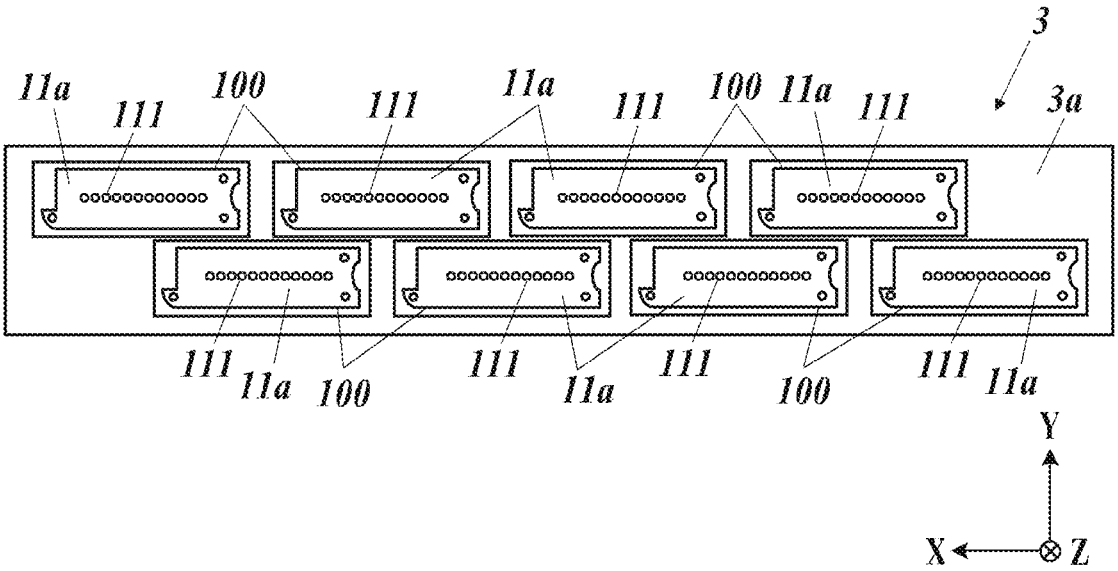
FIG. 2 is a diagram schematically showing a configuration of a head unit.

FIG. 2 is a schematic diagram showing a configuration of the head unit 3, and is a plan view viewing the head unit 3 from the side opposite of the conveying surface of the conveying belt 2*c*. The head unit 3 includes a plate shaped base 3*a*, and a plurality of inkjet heads 100 (here, eight) fixed to the base 3*a* in a state fitted in penetrating holes provided in the base 3*a*. The inkjet head 100 is fixed to the base 3*a* in a state in which a nozzle opening surface 11*a* provided with an opening of a nozzle 111 is exposed toward a −Z-direction from the penetrating hole of the base 3*a*.

In the inkjet head 100, a plurality of nozzles 111 are arranged in a direction intersecting with the conveying direction of the recording medium M (width direction orthogonal to the conveying direction, that is, X-direction according to the present embodiment) with even intervals in between. That is, the inkjet heads 100 include a column of nozzles 111 (nozzle column) arranged one dimensionally with even intervals along the X-direction.

The inkjet head 100 may include a plurality of nozzle columns. In this case, the plurality of nozzle columns are positioned with the positions in the X-direction shifted from each other so that the positions of the nozzles 111 in the X-direction do not overlap.

The eight inkjet heads 100 in the head unit 3 are positioned in a hound's tooth pattern so that a position range of the nozzle 111 in the X-direction is continuous. The position range of the nozzles 111 in the X-direction included in the head unit 3 cover the width in the X-direction of the region where the image can be recorded in the recording medium M conveyed by the conveying belt 2*c*. The head unit 3 is used with the position fixed when the image is recorded, and the ink is emitted from the nozzle 111 in positions with predetermined intervals in between in the conveying direction (conveying direction interval) in response to the conveying of the recording medium M. With this, the head unit 3 records the image with a single pass method.

Figure 3:
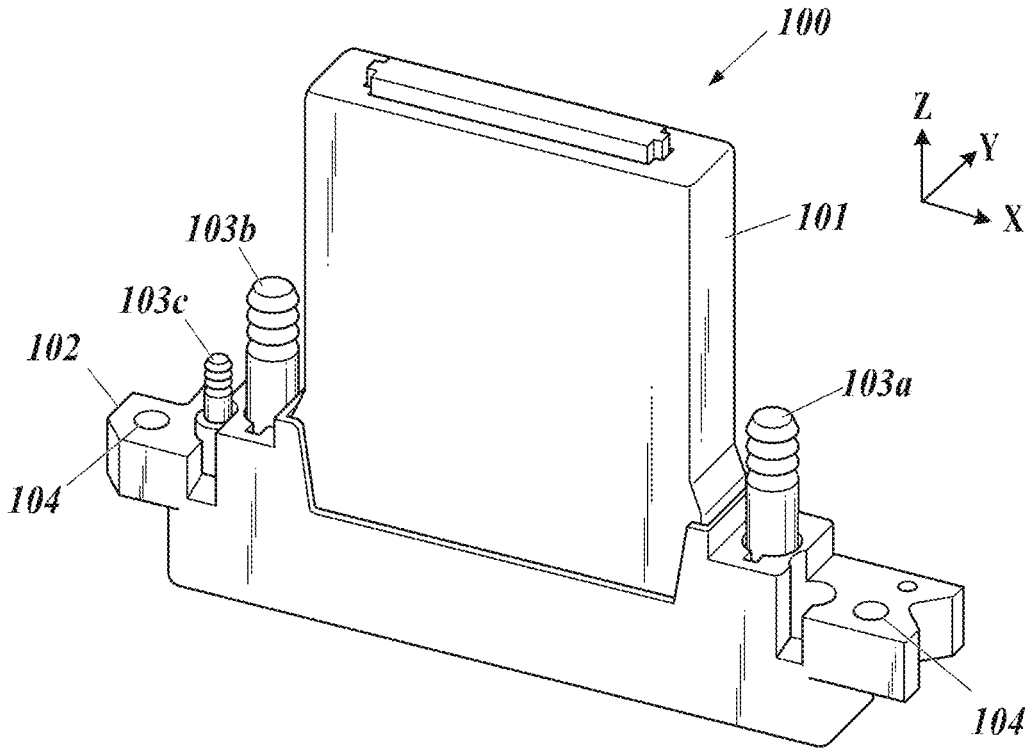
FIG. 3 is a perspective view showing the inkjet head.

FIG. 3 is a perspective diagram showing the inkjet head 100.

The inkjet head 100 includes a case 101, and an exterior unit 102 which fits with the case 101 at the bottom edge of the case 101. The main composing elements are stored in the case 101 and the exterior unit 102. The exterior unit 102 is provided with an inlet 103*a* in which ink is supplied from the outside, and outlets 103*b* and 103*c* from which ink is discharged outside. The exterior unit 102 is provided with a plurality of attaching holes 104 to attach the inkjet head 100 to the base 3*a* of the head unit 3.

Figure 4:
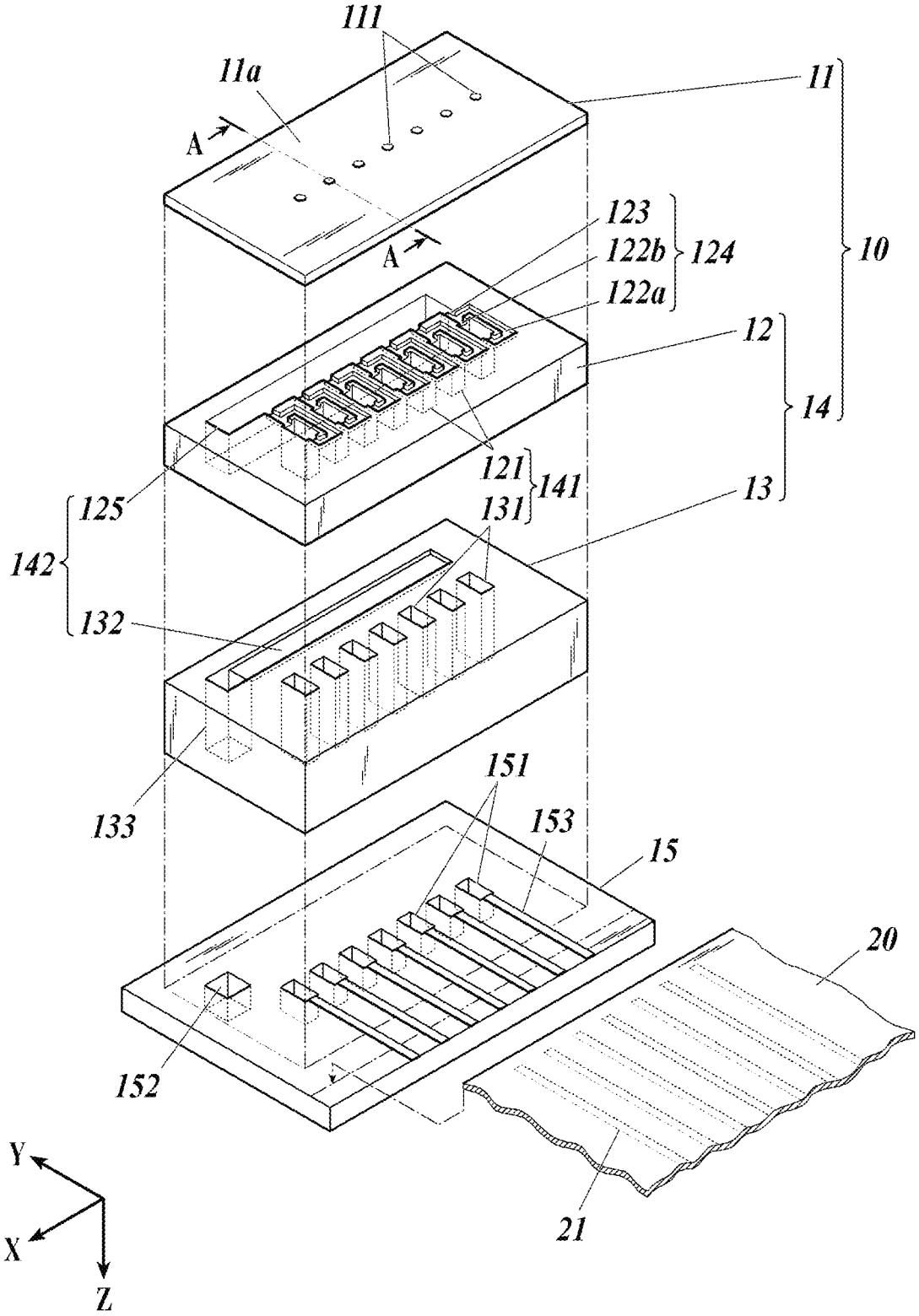
FIG. 4 is an exploded perspective view showing the main portions of the inkjet head.

FIG. 4 is an exploded perspective view of main units in the inkjet head 100.

In FIG. 4, among the composing members in the inkjet head 100, the main composing members stored in the exterior unit 102 are shown. Specifically, FIG. 4 shows a nozzle substrate 11, a head chip 10 including a flow path spacer substrate 12 and a pressure chamber substrate 13, a wiring substrate 15 fixed to the head chip 10 and a FPC 20 (Flexible Printed Circuit) electrically connected to the wiring substrate 15.

FIG. 4 illustrates each member so that the nozzle opening surface 11*a* of the inkjet head 100 is on top, that is, the members are illustrated upside down from FIG. 3. Below, the surface of each substrate on the side of the −Z-direction is to be a top surface and the surface on the side of the +Z-direction is to be the bottom surface.

The head chip 10 includes a nozzle substrate 11 in which a nozzle 111 is provided, a flow path spacer substrate 12 in which a penetrating flow path 121, etc. connected to the nozzle 111 is provided, and a pressure chamber substrate 13 provided with a pressure chamber 131 (ink storage) connected to the nozzle 111 through the penetrating flow path 121, in a layered structure. Below, the substrate including the flow path spacer substrate 12 and the pressure chamber substrate 13 are called the flow path substrate 14.

The nozzle substrate 11, the flow path spacer substrate 12 and the pressure chamber substrate 13, and the wiring substrate 15 are all plate-shaped units in a substantial quadrangular prism long in the X-direction.

The nozzle substrate 11 is a polyimide substrate in which nozzles 111 which are holes penetrating in a thickness direction (Z-direction) are provided as columns along the X-direction. The top surface of the nozzle substrate 11 is the nozzle opening surface 11*a* of the inkjet head 100. The thickness of the nozzle substrate 11 (and therefore the length of the nozzle 111 in the ink emitting direction) is about a few tens of μm to about a few hundreds of μm, for example.

An inner wall surface of the nozzle 111 can include a tapered shape so that the cross-section area orthogonal in the Z-direction becomes smaller closer to the opening on the ink emitting side. Further, as the nozzle substrate 11, substrates using various types of resin other than polyimide, silicon substrates, and metallic substrates such as SUS can also be used.

A water repellent film including liquid repellent substances such as fluorine resin particles is provided in the nozzle opening surface 11*a* of the nozzle substrate 11. By providing the water repellent film, the ink and the foreign substances attaching to the nozzle opening surface 11*a* can be suppressed, and the ink emission failure occurring due to the attaching of the ink and the foreign substances can be suppressed.

The flow path spacer substrate 12 is provided with a penetrating flow path 121 connected to the nozzle 111, a first precedent stage individual discharge flow path 122*a* and a second precedent stage individual discharge flow path 122*b* divided from the penetrating flow path 121, a subsequent stage individual discharge flow path 123 in which the first precedent stage individual discharge flow path 122*a* joins the second precedent stage individual discharge flow path 122*b*, and a belt shaped penetrating flow path 125 which is connected to the subsequent stage individual discharge flow path 123. Among the above, the penetrating flow path 121, the first precedent stage individual discharge flow path 122*a*, the second precedent stage individual discharge flow path 122*b*, and the subsequent stage individual discharge flow path 123 are provided to correspond to each of the plurality of nozzles 111.

The pressure chamber substrate is provided with a pressure chamber 131 connected to the penetrating flow path 121 and a groove shaped flow path 132 connected to the belt shaped penetrating flow path 125, and a vertical discharge flow path 133 divided from the groove shaped flow path 132. The pressure chamber 131 is provided corresponded to each of the plurality of nozzles 111.

The flow path spacer substrate 12 and the pressure chamber substrate 13 are plate shaped units in a rectangular parallelepiped with the substantially the same shape as the nozzle substrate 11 when viewed from the Z-direction.

The flow path spacer substrate 12 according to the present embodiment includes a silicon substrate. The thickness of the flow path spacer substrate 12 is not limited, but is to be about a few hundreds of μm. The nozzle substrate 11 is attached to the top surface of the flow path spacer substrate 12, and the pressure chamber substrate 13 is attached to the bottom surface of the flow path spacer substrate 12 using adhesive.

The material of the pressure chamber substrate 13 is a ceramic piezoelectric body (unit which deforms in response to applying voltage). As an example of such piezoelectric body there are, PZT (lead zirconate titanate), lithium niobate, barium titanate, lead titanate, and lead metaniobate. PZT is used in the pressure chamber substrate 13 according to the present embodiment.

The penetrating flow path 121 of the flow path spacer substrate 12 is a penetrating hole which penetrates the flow path spacer substrate 12 in the Z-direction, and a cross-section orthogonal to the Z-direction forms a rectangle long in the Y-direction. The pressure chamber 131 of the pressure chamber substrate 13 is a penetrating hole which penetrates the pressure chamber substrate 13 in the Z-direction, and the shape of the cross-section orthogonal to the Z-direction is the same as the penetrating flow path 121. In the state in which the flow path spacer substrate 12 is joined with the pressure chamber substrate 13, the penetrating flow path 121 and the pressure chamber 131 are formed as one to be a channel 141 (ink storage). The channel 141 is provided in a position overlapping with the nozzle 111 viewed from the Z-direction and is connected to the nozzle 111. The ink is supplied to the channels 141 through an ink supply opening 151 provided in the wiring substrate 15 and stored in the channels 141.

Figure 5:
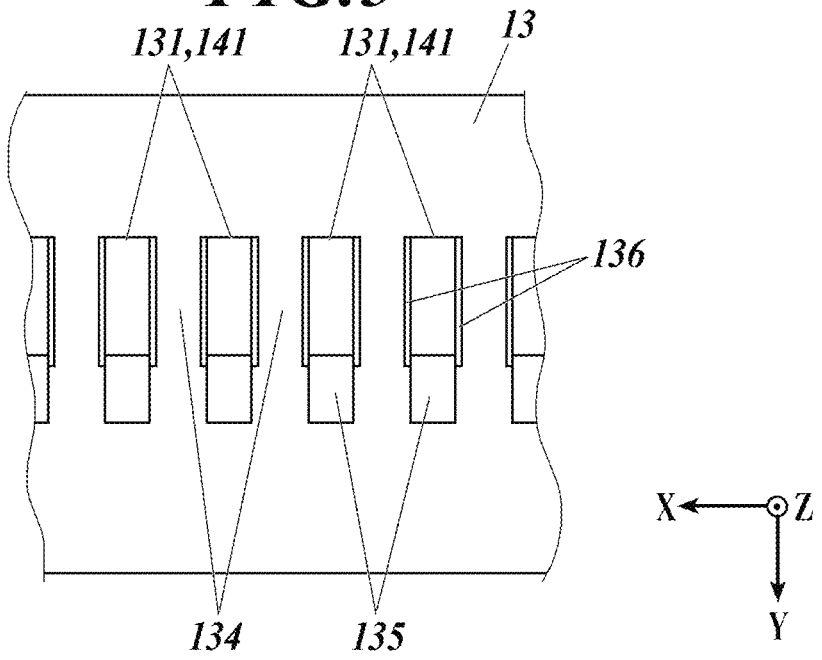
FIG. 5 is an enlarged plan view of the lower surface of a pressure chamber substrate.

FIG. 5 is an enlarged plan view of the bottom surface of the pressure chamber substrate 13.

As shown in FIG. 5, the pressure chambers 131 are divided with partition walls 134 formed of the piezoelectric body between the pressure chambers 131 adjacent in the X-direction. A metal driving electrode 136 (pressure changer) is provided on inner wall surfaces of the partition walls 134 of the pressure chambers 131. A metal connection electrode 135 electrically connected to the driving electrode 136 is provided in the region near the side in the +Y-direction of the opening of the pressure chamber 131 on the surface of the pressure chamber substrate 13. The connection electrode 135 is electrically connected to an external driving circuit through the wiring 153 of the wiring substrate 15 shown in FIG. 4 and wiring 21 of a FPC 20.

In the pressure chamber substrate 13, the partition wall 134 repeats the shear mode displacement in response to a driving signal applied to the driving electrode 136 through the connection electrode 135, and with this, the pressure of the ink in the pressure chamber 131 (therefore, in the channel 141) changes. According to the change in the pressure, the ink in the channel 141 is emitted from the nozzle 111. That is, the head chip 10 according to the present embodiment is a head chip to perform shear mode type emission of ink.

An air chamber which does not include a flow-in path of ink can be provided instead of the channel 141 in every other position where the channel 141 is formed in the X-direction as shown in FIG. 4 and FIG. 5. According to such configuration, when the partition wall 134 adjacent to the channel 141 is deformed, it is possible to not apply influence of the deforming to the other channels 141.

As shown in FIG. 4, a belt shaped penetrating flow path 125 which extends along the arrangement direction (X-direction) of the channel 141 and which penetrates the flow path spacer substrate 12 in the Z-direction is provided in the flow path spacer substrate 12. In the surface joined with the flow path spacer substrate 12 of the pressure chamber substrate 13, a groove-shaped flow path 132 is provided in the position overlapped with the belt shaped penetrating flow path 125 viewed from the Z-direction. When the flow path spacer substrate 12 is joined with the pressure chamber substrate 13, the belt shaped penetrating flow path 125 and the groove shaped flow path 132 form the common discharge flow path 142 extending in the X-direction. The common discharge flow path 142 according to the above configuration extends along the joined surface between the flow path spacer substrate 12 and the nozzle substrate 11 (therefore, the joined surface between the flow path substrate 14 and the nozzle substrate 11) and a portion of the side wall is formed of the nozzle substrate 11.

At the end of the common discharge flow path 142 on the side in the +X-direction, a vertical discharge flow path 133 is connected to penetrate the pressure chamber substrate 13 in the Z-direction.

As described above, the flow path spacer substrate 12 is provided with the first precedent stage individual discharge flow path 122*a* and the second precedent stage individual discharge flow path 122*b* divided from each of the plurality of penetrating flow paths 121 (channel 141) and the subsequent stage individual discharge flow path 123 in which the first precedent stage individual discharge flow path 122*a* joins with the second precedent stage individual discharge flow path 122*b*, and the subsequent stage individual discharge flow path 123 is connected to the band shaped penetrating flow path 125. The first precedent stage individual discharge flow path 122*a*, the second precedent stage individual discharge flow path 122*b*, and the subsequent stage individual discharge flow path 123 are groove shaped flow paths provided along the surface on the top surface side of the flow path spacer substrate 12, and a part of the side wall forms the nozzle substrate 11. Below, the first precedent stage individual discharge flow path 122*a*, the second precedent stage individual discharge flow path 122*b*, and the subsequent stage individual discharge flow path 123 may be collectively described as an individual discharge flow path 124. The detailed configuration of the individual discharge flow path 124 will be described later.

In the flow path substrate 14 including the flow path spacer substrate 12 and the pressure chamber substrate 13 according to the present embodiment, some of the ink which is not discharged from the nozzle 111 among the ink supplied to the channel 141 is discharged outside through the individual discharge flow path 124 and the common discharge flow path 142. That is, the ink which passes the individual discharge flow path 124 and the common discharge flow path 142 passes the vertical discharge flow path 133 and the discharge hole 152 provided in the wiring substrate 15 and is discharged outside of the inkjet head 100 from the outlet 103*b* (or the outlet 103*c*).

The flow of the ink supplied from the ink supply opening 151 to the channel 141 and the flow of the ink from the channel 141 through the individual discharge flow path 124 and the common discharge flow path 142 to be discharged can be caused by an ink circulation mechanism 9 (FIG. 8) included in the inkjet recording device 1. The configuration of the ink circulation mechanism 9 is described later.

Preferably, the wiring substrate 15 is a plate-shaped substrate including a square area larger than the square area of the pressure chamber substrate 13 from the view point of securing the connecting region with the pressure chamber substrate 13. The wiring substrate is attached to the bottom surface of the pressure chamber substrate 13 with adhesive. As the wiring substrate 15, a substrate including, for example, glass, ceramics, silicon, plastic can be used.

The wiring substrate 15 is provided with a plurality of ink supply openings 151 in a position overlapped with the channel 141 viewed from the Z-direction and a discharge opening 152 in a position overlapped with the vertical discharge flow path 133. In the surface of the wiring substrate 15 attached to the pressure chamber substrate 13, a plurality of wiring 153 are provided extending from each end of the plurality of ink supply openings 151 toward the end of the wiring substrate 15.

An ink manifold (common ink chamber) (not shown) is connected to the bottom surface of the wiring substrate 15, and the ink is supplied from the ink manifold to the ink supply opening 151.

The pressure chamber substrate 13 and the wiring substrate 15 are attached through a conductive adhesive including a conductive particle. With this, the connection electrode 135 on the surface of the pressure chamber substrate 13 and the wiring 153 on the wiring substrate 15 are electrically connected through the conductive particles.

An FPC 20 is connected to an end in which the wiring 153 is provided in the wiring substrate 15 by using an ACF (anisotropy conductive film) for example. According to such connection, each of the plurality of wiring 153 on the wiring substrate 15 and each of the plurality of wiring 21 on the FPC 20 are electrically connected corresponded one to one.

Next, the detailed configuration of the individual discharge flow path 124 is described.

Figure 6:
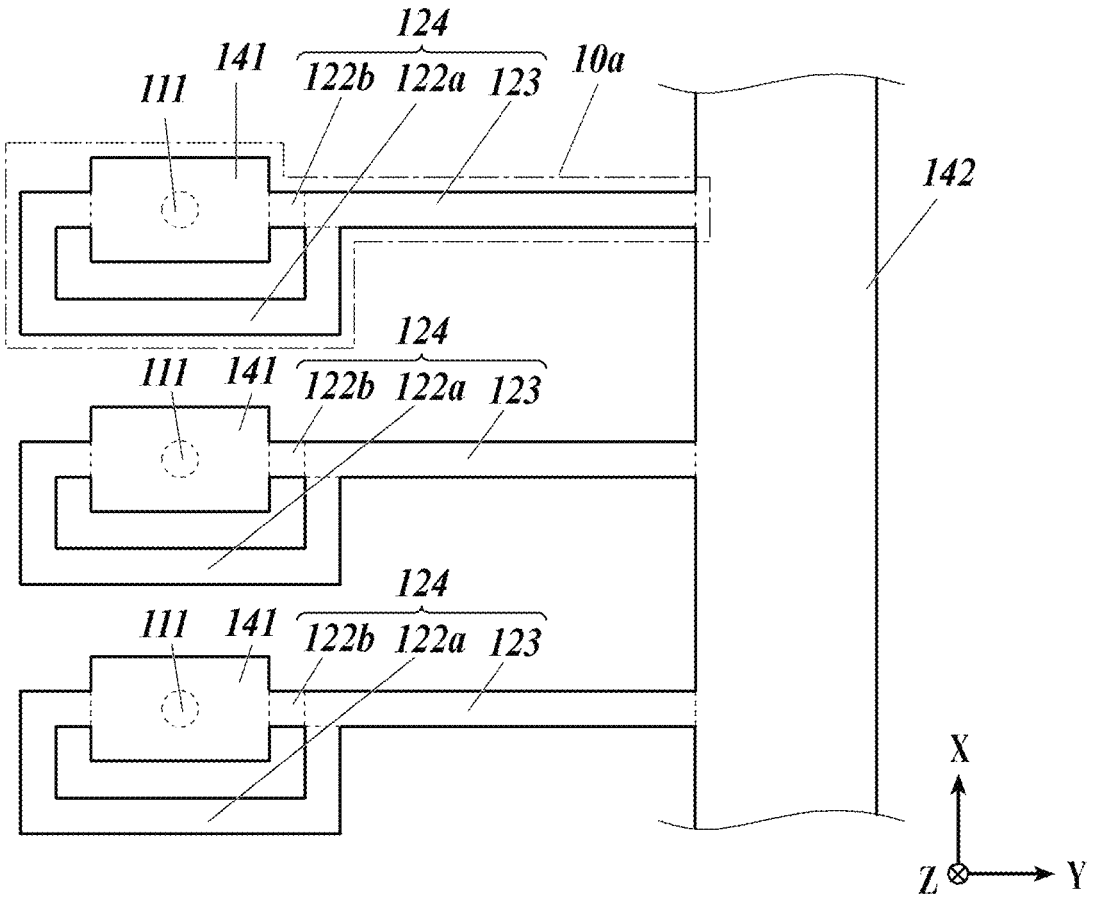
FIG. 6 is a plan view showing a configuration of individual discharge flow paths.

FIG. 6 is a plan view showing a configuration of the individual discharge flow path 124. FIG. 6 is a diagram showing an enlarged state of a region where the individual discharge flow path 124 is formed on the top surface of the flow path spacer substrate 12. The ink emitter 10*a* is a mechanism for discharging ink from the nozzle 111 including the individual discharge flow path 124, the nozzle 111, the channel 141, and the above-described driving electrode 136. Therefore, the number of ink emitters 10*a* are provided to be the same as the number of nozzles 111 in the head chip 10.

As shown in FIG. 6, from each of the plurality of channels 141, the first precedent stage individual discharge flow path 122*a* is divided in the −Y-direction side and the second precedent stage individual discharge flow path 122*b* is divided in the +Y-direction side. That is, the first precedent stage individual discharge flow path 122*a* and the second precedent stage individual discharge flow path 122*b* are connected in the opposite direction from each other with relation to the channel 141. In detail, the first precedent stage individual discharge flow path 122*a* and the second precedent stage individual discharge flow path 122*b* are each divided from both ends opposite to each other in a rectangle formed by the channel 141 from a plan view (pair of short ends). Here, connected in the opposite direction with relation to the channel 141 means the discharge direction of the ink in each flow path is in the opposite direction. Therefore, the configuration is not limited to the two precedent stage individual discharge flow paths being on a straight line, and the above can be on straight lines different from each other.

The first precedent stage individual discharge flow path 122*a* and the second precedent stage individual discharge flow path 122*b* are joined to one subsequent stage individual discharge flow path 123 extending in the +Y-direction. The second precedent stage individual discharge flow path 122*b* and the subsequent stage individual discharge flow path 123 are connected in one line, and the first precedent stage individual discharge flow path 122*a* joins the subsequent stage individual discharge flow path 123 from the vertical direction after going around the side of the penetrating flow path 121 (−X-direction side). Specifically, after dividing to the −Y-direction side from the penetrating flow path 121, the first precedent stage individual discharge flow path 122*a* bends in the −X-direction and the +Y-direction in this order and passes the side of the penetrating flow path 121. Then, the first precedent stage individual discharge flow path 122*a* bends in the +X-direction to be connected in the subsequent stage individual discharge flow path 123. Then, among the first precedent stage individual discharge flow path 122*a* and the second precedent stage individual discharge flow path 122*b* connected to each nozzle 111 with the exception of the nozzle 111 at the edge of the −X-direction side, only the first precedent stage individual discharge flow path 122*a* passes between adjacent nozzles 111 viewed from the Z-direction (side in the ink emitting direction from the nozzle 111).

According to the above configuration, some of the ink which is not emitted from the nozzle 111 among the ink supplied to the channel 141 is discharged through the first precedent stage individual discharge flow path 122*a* or the second precedent stage individual discharge flow path 122*b* and the subsequent stage individual discharge flow path 123 to the common discharge flow path 142. With this, the bubbles and the foreign substances mixed in the channel 141 are discharged to the common discharge flow path 142 with the ink.

Figure 7:
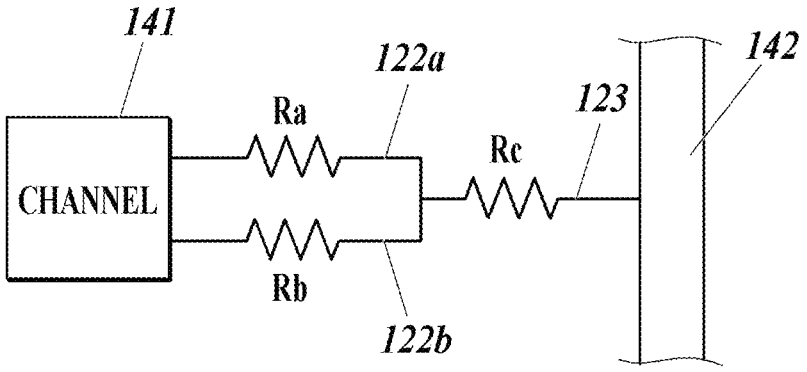
FIG. 7 is a diagram which describes flow path resistance of the individual discharge flow path.

FIG. 7 is a diagram describing the flow path resistance of the individual discharge flow path 124.

FIG. 7 shows an equivalent circuit of the individual discharge flow path 124 using the flow path resistance Ra of the first precedent stage individual discharge flow path 122*a*, the flow path resistance Rb of the second precedent stage individual discharge flow path 122*b*, and the flow path resistance Rc of the subsequent stage individual discharge flow path 123. The flow path resistance Ra and the flow path resistance Rb are connected parallel with relation to the channel, and the flow path resistance Rc is connected serially to the common discharge flow path 142 on the downstream side of the flow path resistance Ra and the flow path resistance Rb connected in parallel.

The entire combined flow path resistance R in the individual discharge flow path 124 according to the above configuration is shown with the following formula (1).

$$R=Ra\cdot Rb/(Ra+Rb)+Rc \quad (1)$$

Here, the flow path resistance shows the size of the energy lost by the friction with the wall or the turbulence occurring when the ink as a fluid flows in the flow path. Such energy loss appears as pressure loss of the ink in the flow path. Therefore, the flow path resistance (combined flow path resistance) shows the size of the pressure loss (combined pressure loss) of ink in the flow path.

When the pressure wave according to the change in the pressure of the ink in the channel 141 passes through the individual discharge flow path 124 and the common discharge flow path 142 and is transmitted (reflected) to the channel 141 of any of the ink emitters 10*a*, the predetermined pressure cannot be applied to the ink in the channel 141 and the change in the ink emitting characteristics occur (cross talk). This leads to decrease in the image quality. Therefore, in order to make it difficult for the pressure wave to pass through the individual discharge flow path 124 to be transmitted to the common discharge flow path 142, the pressure loss (flow path resistance) of the ink in the individual discharge flow path 124 is preferably large in the range in which the necessary ink discharge amount can be secured.

From the viewpoint of making the bubbles and the foreign substances which can pass the individual discharge flow path 124 as large as possible, preferably, the cross-section area (area of the cross-section orthogonal to the discharge direction of the ink, same can be said below) in each position of the individual discharge flow path 124 is secured, and the flow path is made long to increase the pressure loss. However, lately, in the inkjet head, the device is becoming smaller and the arrangement of the nozzle is becoming denser. Since there is a limit to the region in which the first precedent stage individual discharge flow path 122*a* and the second precedent stage individual discharge flow path 122*b* can be positioned, the flow path cannot be made to a sufficient length according to the method in which the first precedent stage individual discharge flow path 122*a* and the second precedent stage individual discharge flow path 122*b* are made long to be directly connected to the common discharge flow path 142 (that is, the pressure loss cannot be sufficiently increased). Therefore, it is difficult to sufficiently suppress the decrease in image quality due to the pressure wave being transmitted.

Here, according to the inkjet head 100 of the present embodiment, the cross-section area necessary for the first precedent stage individual discharge flow path 122*a* and the second precedent stage individual discharge flow path 122*b* is secured, and the first precedent stage individual discharge flow path 122*a* and the second precedent stage individual discharge flow path 122*b* are joined to the subsequent stage individual discharge flow path 123 and the subsequent stage individual discharge flow path 123 is made long. With this, it is possible to sufficiently increase the pressure loss while making the entire region in which the individual discharge flow path 124 is formed to be smaller. In FIG. 6 the subsequent stage individual discharge flow path 123 is in one straight line, but alternatively depending on the size of the region which can be used and the size of the necessary pressure loss, the shape can be meandering.

According to such configuration, the pressure loss of the ink in such subsequent stage individual discharge flow path 123 becomes larger than the pressure loss (combined pressure loss of ink) in the first precedent stage individual discharge flow path 122*a* and the second precedent stage individual discharge flow path 122*b*.

The minimum value of the cross-section area in the subsequent stage individual discharge flow path 123 is equal to or larger than the minimum value of the cross-section area in each of the first precedent stage individual discharge flow path 122*a* and the second precedent stage individual discharge flow path 122*b*. With this, the bubbles and the foreign substances which can pass the first precedent stage individual discharge flow path 122*a* and the second precedent stage individual discharge flow path 122*b* can also pass the subsequent stage individual discharge flow path 123. In other words, the cross-section area necessary for discharging the bubbles and the foreign substances is secured in the subsequent stage individual discharge flow path 123 and the length of the subsequent stage individual discharge flow path 123 is adjusted. With this, the entire pressure loss of the individual discharge flow path 124 is increased.

Among the first precedent stage individual discharge flow path 122*a* and the second precedent stage individual discharge flow path 122*b*, only the first precedent stage individual discharge flow path 122*a* goes around the side of the channel 141. Therefore, the length of the first precedent stage individual discharge flow path 122*a* and the length of the second precedent stage individual discharge flow path 122*b* are different. As a result, the pressure loss of the ink in the first precedent stage individual discharge flow path 122*a* and the pressure loss of the ink in the second precedent stage individual discharge flow path 122*b* are different. Since the length and the pressure loss in the two precedent stage individual discharge flow paths are different, when the pressure waves from the channel 141 entering the two precedent stage individual discharge flow paths join at the subsequent stage individual discharge flow path 123, the conditions so that the pressure waves cancel each other out (make each other weaker) can be easily satisfied.

If the difference in the pressure loss of the ink between the first precedent stage individual discharge flow path 122*a* and the second precedent stage individual discharge flow path 122*b* is too large, the difference between the ink amount flowing in from the channel 141 to the first precedent stage individual discharge flow path 122*a* and the ink amount flowing in from the channel 141 to the second precedent stage individual discharge flow path 122*b* becomes large, and it becomes difficult to obtain the effect of discharging the bubbles and the foreign substances through one precedent stage individual discharge flow path. Therefore, preferably, the pressure loss (value dividing the pressure loss in the entire flow path by the length) for each unit of the length in the first precedent stage individual discharge flow path 122*a* relatively longer between the first precedent stage individual discharge flow path 122*a* and the second precedent stage individual discharge flow path 122*b* is smaller than the pressure loss for each unit of the length in the second precedent stage individual discharge flow path 122*b* and the difference of the pressure loss is reduced. For example, when the cross-section area in the precedent stage individual discharge flow path is the same, by making the cross-section area in the relatively longer first precedent stage individual discharge flow path 122*a* larger than the cross-section area of the second precedent stage individual discharge flow path 122*b*, the pressure loss for each unit of the length in the first precedent stage individual discharge flow path is made relatively smaller, and the difference of the pressure loss in the two precedent stage individual discharge flow paths can be reduced.

The configuration can include three or more precedent stage individual discharge flow paths divided from one channel 141 and the precedent stage individual discharge flow paths can be joined at the subsequent stage individual discharge flow path 123. In this case also, preferably, each of the lengths in the plurality of the precedent stage individual discharge flow paths are to be a different length from the length of the other precedent stage individual discharge flow path. Further, the pressure loss for each unit of the length can be made smaller in the precedent stage individual discharge flow path which is longer among the plurality of individual discharge flow paths. Preferably, the pressure loss in the ink in each of the plurality of precedent stage individual discharge flow paths is made to be different from the pressure loss of the ink in any of the other precedent stage individual discharge flow paths.

Next, the configuration of the ink circulation mechanism 9 in the inkjet head 100 in order to circulate the ink and to discharge the ink is described.

Figure 8:
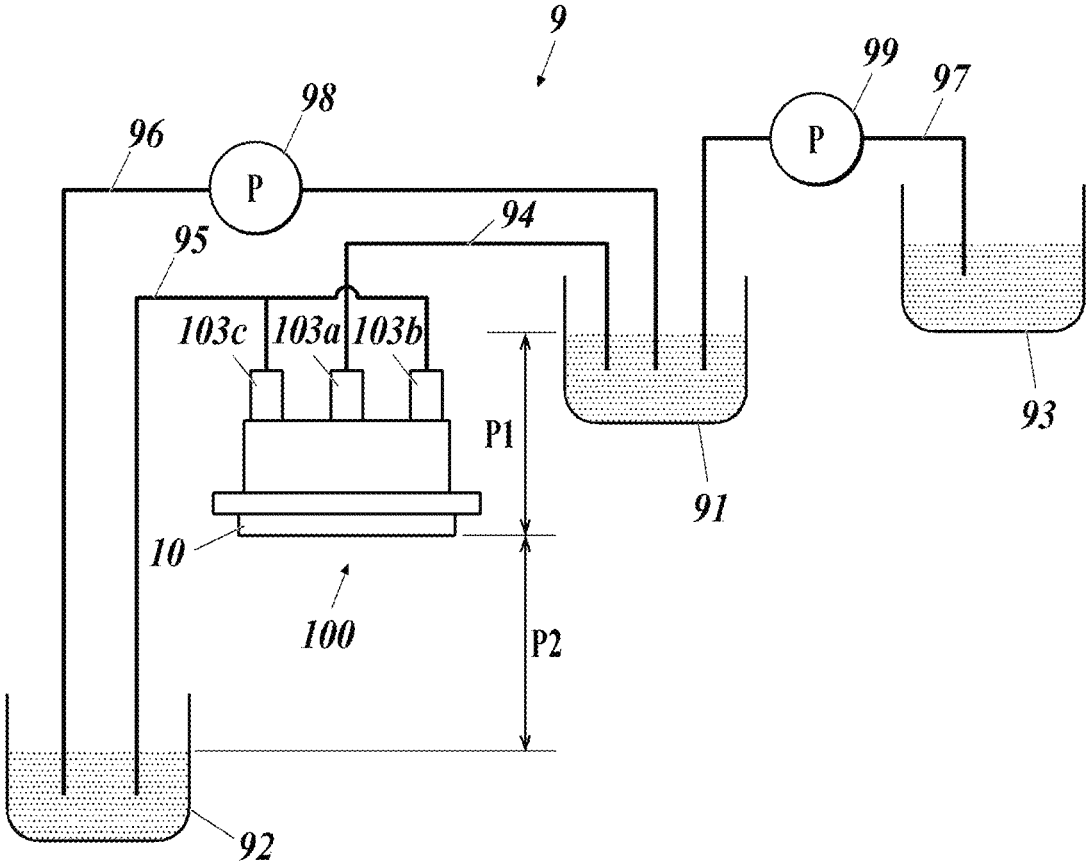
FIG. 8 is a schematic diagram showing a configuration of an ink circulation mechanism.

FIG. 8 is a schematic drawing showing a configuration of the ink circulation mechanism 9.

The ink circulation mechanism 9 includes a supply sub-tank 91, a circulating sub-tank 92, and a main tank 93.

The supply sub-tank 91 stores ink supplied to the ink manifold provided in the inkjet head 100. The supply sub-tank 91 is connected to the inlet 103*a* by an ink flow path 94.

The circulating sub-tank 92 is connected to the outlets 103*b* and 103*c* by an ink flow path 95, and stores ink which passes the above-described ink discharge flow paths including the individual discharge flow path 124 and the common discharge flow path 142 and which is discharged from the outlet 103*b* or the outlet 103*c*.

The supply sub-tank 91 and the circulating sub-tank 92 are connected by an ink flow path 96. With the pump 98 provided in the ink flow path 96, the ink can be returned from the circulating sub-tank 92 to the supply sub-tank 91.

The main tank 93 stores the ink supplied to the supply sub-tank 91. The main tank 93 is connected to the supply sub-tank 91 by the ink flow path 97. The ink is supplied from the main tank 93 to the supply sub-tank 91 by the pump 99 provided in the ink flow path 97.

The liquid surface of the supply sub-tank 91 is provided in the position higher than the ink emitting surface of the head chip 10 (hereinbelow also referred to as "position standard surface"), and the liquid surface of the circulating sub-tank 92 is provided in the position lower than the position standard surface. Therefore, pressure P1 according to a water head difference between the position standard surface and the supply sub-tank 91, and the pressure P2 according to a water head difference between the position standard surface and the circulating sub-tank 92 occur. As a result, the pressure of the ink in the inlet 103*a* is higher than the pressure of the ink in the outlets 103*b* and 103*c*. According to such pressure difference, the flow of ink occurs from the inlet 103*a*, through the ink manifold, the ink supply opening 151, the channel 141, the penetrating flow path 121, the individual discharge flow path 124, the common discharge flow path 142, the vertical discharge flow path 133, and the discharge hole 152 and then toward the outlets 103*b* and 103*c*. With this, the ink supply to the channel 141 and the ink discharge (circulation) of the ink from the channel 141 is performed. The pressure P1 and the pressure P2 can be adjusted by changing the ink amount in the sub-tank and the position of the sub-tank in the vertical direction. With this, the ink flow velocity can be adjusted.

Next, the simulation to confirm the effect of the embodiment according to the present invention is described.

FIG. 9 is a diagram showing conditions and results of the simulation.

In this simulation, for each comparative example 1 to comparative example 3 including the conventional configuration, and example 1 and example 2 which are embodiments of the present invention, the pressure loss (ratio with relation to comparative example 1) of ink in the individual discharge flow path 124 and the size of the bubbles and the foreign substances which can be discharged are evaluated.

Figure 10A:
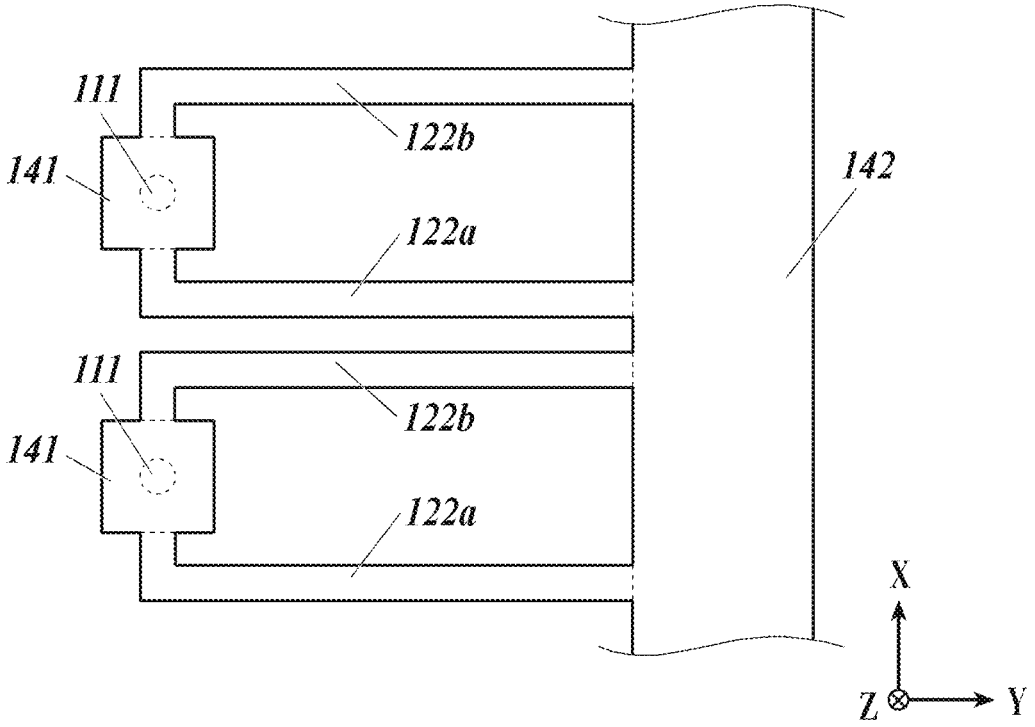
FIG. 10A is a diagram showing a configuration of a comparative example used in the simulation.
Figure 10B:
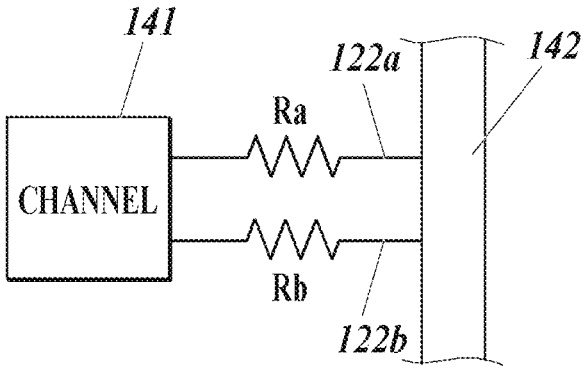
FIG. 10B is a diagram which describes the flow path resistance of the individual discharge flow path according to a comparative example.

As shown in FIG. 10A, according to the configuration in the comparative example 1 to the comparative example 3, the first precedent stage individual discharge flow path 122*a* and the second precedent stage individual discharge flow path 122*b* divided from the channel 141 are connected to the common discharge flow path 142 as is. The equivalent circuit is as shown in FIG. 10B. The flow path resistance R in the entire individual discharge flow path 124 (first precedent stage individual discharge flow path 122*a* and second precedent stage individual discharge flow path 122*b*) in the comparative example 1 to the comparative example 3 satisfy the equation (2) below.

$$R=Ra\cdot Rb/(Ra+Rb) \quad (2)$$

According to the configuration shown in FIG. 10A, in the comparative example 1, the width and the depth of the flow path are 0.05 mm, and the length of the first precedent stage individual discharge flow path 122*a* and the second precedent stage individual discharge flow path 122*b* are each to be 1.5 mm.

According to the configuration shown in FIG. 10A, in the comparative example 2, the width and the depth of the flow path are 0.06 mm, and the length of the first precedent stage individual discharge flow path 122*a* and the second precedent stage individual discharge flow path 122*b* are each to be 1.5 mm.

According to the configuration shown in FIG. 10A, in the comparative example 3, the width and the depth of the flow path are 0.06 mm, and the length of the first precedent stage individual discharge flow path 122*a* and the second precedent stage individual discharge flow path 122*b* are each to be 1.7 mm.

The area occupied by the individual discharge flow path 124 according to the comparative examples 1 to 3 is 0.15 $mm^2$, 0.18 $mm^2$, 0.20 $mm^2$, respectively.

Figure 11:
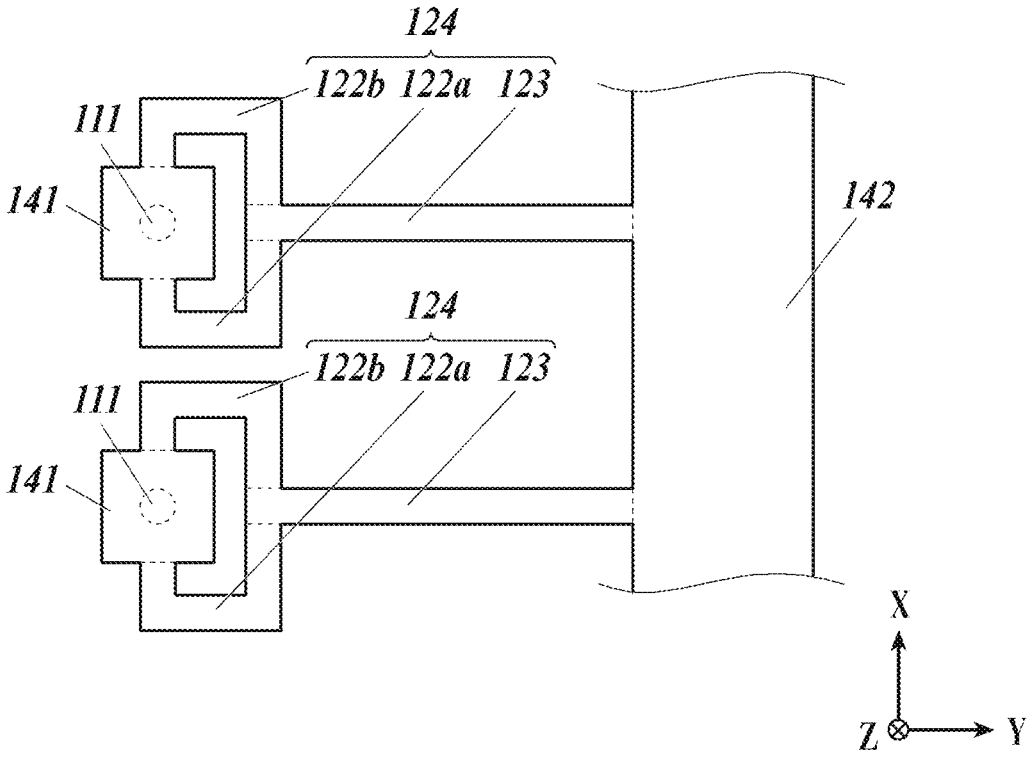
FIG. 11 is a diagram showing a configuration of an embodiment used in the simulation.

To make matters easier, as shown in FIG. 11, in the example 1 and the example 2, the length and the cross-section shape are the same in the first precedent stage individual discharge flow path 122*a* and the second precedent stage individual discharge flow path 122*b*, and the pressure loss is also the same.

According to the configuration shown in FIG. 11, in the example 1, the width and the depth of the flow path are 0.06 mm, the length of the first precedent stage individual discharge flow path 122*a* and the second precedent stage individual discharge flow path 122*b* are each to be 0.7 mm, and the length of the subsequent stage individual discharge flow path 123 is 1.1 mm.

According to the configuration shown in FIG. 11, in the example 2, the width and the depth of the flow path are 0.07 mm, the length of the first precedent stage individual discharge flow path 122*a* and the second precedent stage individual discharge flow path 122*b* are each to be 0.7 mm, and the length of the subsequent stage individual discharge flow path 123 is 1.1 mm.

The area occupied by the individual discharge flow path 124 in the example 1 and the example 2 is 0.15 $mm^2$ and 0.18 $mm^2$, respectively.

The flow paths in the comparative examples 1 to 3 and example 1 and example 2 are square pipe shaped with a square cross-section.

The simulation is performed under the assumption that, due to the design of the head chip 10, the area occupied by the individual discharge flow path 124 needs to be suppressed to less than 0.20 $mm^2$, and the lower limit value of the pressure loss necessary to suppress the transmitting of the pressure wave is a ratio of 0.50 or more with relation to the comparative example 1.

As a result of the simulation, compared with the configuration of the comparison example 1, when the width and the depth of the flow paths are made larger to 0.06 mm as in the comparative example 2, the bubbles and the foreign substances which can be discharged becomes larger from 0.05 mm to 0.06 mm but the pressure loss decreases and becomes a ratio showing 0.48 with relation to the comparative example 1. It is confirmed that the pressure loss becomes smaller than the above-described minimum value.

Compared with the configuration of the comparison example 2, when the first precedent stage individual discharge flow path 122*a* and the second precedent stage individual discharge flow path 122*b* becomes longer to 1.7 mm as in the comparative example 3, the ratio of the pressure loss is improved to 0.55 and becomes more than the minimum value. However, the occupied area is enlarged to 0.20 $mm^2$ and it is confirmed that the condition of the occupied area is not satisfied.

Turning to example 1, by enlarging the width and the depth of the flow paths to 0.06 mm and by making the first precedent stage individual discharge flow path 122*a* and the second precedent stage individual discharge flow path 122*b* shorter to 0.7 mm and providing the subsequent stage individual discharge flow path 123, it is confirmed that the bubbles and the foreign substances which can be discharged can be made to be larger to 0.06 mm while securing the occupying area and the pressure loss being the same as the comparative example 1.

As shown in example 2, even if the width and the depth of the flow paths are enlarged to 0.07 mm and the bubbles and the foreign substances which can be discharged are made larger to 0.07 mm, it is confirmed that the above conditions regarding the occupying area and the pressure loss can be satisfied.

As described above, according to the example of the present invention provided with the subsequent stage individual discharge flow path 123, even if the space to position the individual discharge flow path 124 is limited, it is confirmed that it is possible to sufficiently obtain pressure loss in which the transmitting of the pressure wave can be suppressed and that larger bubbles and foreign substances can be discharged. Although not described in FIG. 9, according to the example of the present invention in which the space for positioning the individual discharge flow path 124 and the area of the cross-section (size of foreign substance which can be discharged) of the flow path is maintained to the value in the comparative example 1 and the subsequent stage individual discharge flow path 123 is made long, the pressure loss in the individual discharge flow path 124 can be increased.

As described above, the inkjet head 100 according to the present embodiment includes, the plurality of ink emitters 10*a*, each of the ink emitters 10*a* including, the channel 141 as an ink storage which stores ink, the driving electrode 136 as the pressure changer which changes the pressure applied to the ink stored in the channel 141, the nozzle 111 which is connected to the channel 141 and which emits ink according to the change in the pressure of the ink in the channel 141, the first precedent stage individual discharge flow path 122*a* and the second precedent stage individual discharge flow path 122*b* which are connected to the channel 141 and through which ink which is not supplied from the channel 141 to the nozzle 111 and discharged passes, and the subsequent stage individual discharge flow path 123 where the first precedent stage individual discharge flow path 122*a* and the second precedent stage individual discharge flow path 122*b* join, and the common discharge flow path 142 which connects to a plurality of subsequent stage individual discharge flow paths 123 included in the plurality of ink emitters 10*a* and in which the ink passing the plurality of subsequent stage individual discharge flow path 123 flows into.

According to the above configuration, among the first precedent stage individual discharge flow path 122*a*, the second precedent stage individual discharge flow path 122*b*, and the subsequent stage individual discharge flow path 123 included in the individual discharge flow path 124, by making the subsequent stage individual discharge flow path 123 long, the pressure loss of the ink in the individual discharge flow path 124 can be effectively increased while suppressing the increase of the region occupied by the individual discharge flow path 124. That is, compared to increasing the pressure loss by making the first precedent stage individual discharge flow path 122*a* and the second precedent stage individual discharge flow path 122*b* longer in the conventional configuration including the individual discharge flow path 124 directly connecting the first precedent stage individual flow path 122*a* and the second precedent stage individual discharge flow path 122*b* with the common discharge flow path 142, the amount which needs to be increased in the region occupied by the individual discharge flow path 124 in order to increase the pressure loss in a predetermined amount can be suppressed to a small amount. Therefore, the pressure loss of ink in the individual discharge flow path 124 can be effectively increased without making the cross-section area of the flow path small (that is, while maintaining the size of the bubbles and the foreign substances which can be discharged). With this, the pressure wave transmitted from the channel 141 to the common discharge flow path 142 can be suppressed. Alternatively, while suppressing the region occupied by the individual discharge flow path 124 to be small, and securing the pressure loss to be able to sufficiently suppress the transmitting of the pressure wave, the cross-section area of the flow path can be made large, and the bubbles and the foreign substances in a larger size can be discharged.

Therefore, according to the above configuration, the image quality reduction due to the transmitting of the pressure wave and the image quality reduction due to the bubbles and the foreign substances can be effectively suppressed.

By making the length of the first precedent stage individual discharge flow path 122*a* and the second precedent stage individual discharge flow path 122*b* differently, when the pressure waves entering the two precedent stage individual discharge flow paths from the channel 141 join at the subsequent stage individual discharge flow path 123, the condition to cancel out (weaken each other) the pressure waves can be more easily satisfied. Therefore, the transmitting of the pressure wave from the channel 141 to the common discharge flow path 142 can be more effectively suppressed.

By making the pressure loss for each unit of the length in the first precedent stage individual discharge flow path 122*b* relatively longer between the first precedent stage individual discharge flow path 122*a* and the second precedent stage individual discharge flow path 122*b* smaller than the pressure loss for each unit of the length in the second precedent stage individual discharge flow path 122*b*, the size of the pressure loss in the two precedent stage individual discharge flow paths can be made closer to being even. Therefore, it is possible to suppress the problem of the bubbles and the foreign substances becoming difficult to be discharged from one of the precedent stage individual discharge flow paths.

Even if the pressure loss of the ink in each of the first precedent stage individual discharge flow path 122*a* and the second precedent stage individual discharge flow path 122*b* is made different from each other, when the pressure waves entering the two precedent stage individual discharge flow paths from the channel 141 join in the subsequent stage individual discharge flow path 123, the condition to cancel out (weaken each other) the pressure waves can be more easily satisfied. Therefore, the transmitting of the pressure wave from the channel 141 to the common discharge flow path 142 can be more effectively suppressed.

The subsequent stage individual discharge flow path 123 is made longer so that the pressure loss of ink in the subsequent stage individual discharge flow path 123 is larger than the pressure loss of ink in the first precedent stage individual discharge flow path 122*a* and the second precedent stage individual discharge flow path 122*b* (combined pressure loss). With this, the pressure loss of ink in the individual discharge flow path 124 can be increased efficiently that is, with smaller space.

The minimum value of the cross-section area vertical in the discharge direction of the ink in the subsequent stage individual discharge flow path 123 is equal to or larger than the minimum value of the cross-section area vertical to the discharge direction of the ink in each of the first precedent stage individual discharge flow path 122*a* and the second precedent stage individual discharge flow path 122*b*. With this, the bubbles and the foreign substances which can pass the first precedent stage individual discharge flow path 122*a* and the second precedent stage individual discharge flow path 122*b* can also pass the subsequent stage individual discharge flow path 123. That is, by securing the cross-section area in the subsequent stage individual discharge flow path 123 necessary to discharge the bubbles and the foreign substance and adjusting the length of the subsequent stage individual discharge flow path 123, the pressure loss of the entire individual discharge flow path 124 can be increased without reducing the effect of discharging the bubbles and the foreign substances.

The first precedent stage individual discharge flow path 122*a* and the second precedent stage individual discharge flow path 122*b* are connected in the direction opposite to each other with relation to the channel 141. With this, the bubbles and the foreign substances in the channel 141 can be discharged more effectively.

The plurality of nozzles 111 included in the plurality of ink emitters 10*a* are arranged along a predetermined direction. Between the first precedent stage individual discharge flow path 122*a* and the second precedent stage individual discharge flow path 122*b* connected to the nozzles 111 with the exception of the nozzle at a predetermined one end among the plurality of nozzles 111, only the first precedent stage individual discharge flow path 122*a* passes between adjacent nozzles 111 viewed from the side in the ink discharge direction from the nozzle 111. According to such configuration, the width in the nozzle arrangement direction in the individual discharge flow path 124 can be made small. Therefore, in the inkjet head 100 in which the nozzles 111 are positioned with high density, the individual discharge flow path 124 including the subsequent stage individual discharge flow path 123 can be provided.

The inkjet recording device 1 according to the present embodiment includes an inkjet head 100. Therefore, image quality decrease due to transmitting of the pressure wave and the image quality decrease due to the bubbles and the foreign substances can be effectively suppressed.

The present invention is not limited to the above-described embodiments and modifications, and various changes are possible.

For example, according to the present embodiment, the individual discharge flow path 124 is provided in the flow path spacer substrate 12, but the configuration is not limited to the above. For example, the individual discharge flow path 124 can be provided in the pressure chamber substrate 13 and the nozzle substrate 11. Moreover, the individual discharge flow path 124 is not limited to being formed with a groove provided in a plate surface of the flow path spacer substrate 12. Alternatively, the individual discharge flow path 124 may penetrate the flow path spacer substrate 12 in the thickness direction, and the flow paths can be sealed by attaching and connecting the nozzle substrate 11 and the pressure chamber substrate 13.

According to the present embodiment, the first precedent stage individual discharge flow path 122*a* and the second precedent stage individual discharge flow path 122*b* are divided in directions opposite to each other from both ends of the channel 141, but the present invention is not limited to the above. The flow paths can be divided from other positions where the bubbles and the foreign substances can be effectively discharged according to the shape of the channel 141 and the way the ink flows.

According to the present embodiment, a plurality of subsequent stage individual discharge flow paths 123 are directly connected to the common discharge flow path 142, but the present invention is not limited to the above. That is, the plurality of subsequent stage individual discharge flow paths 123 can be connected to the common discharge flow path 142 with other flow paths and ink chambers in between.

According to the present embodiment, the common discharge flow path 142 includes the penetrating flow path 121 in the flow path spacer substrate 12 and the groove shaped flow path 132 in the pressure chamber substrate 13, but the configuration is not limited to the above. For example, the common discharge flow path 142 can include the groove provided on the surface on the nozzle substrate 11 side of the flow path spacer substrate 12.

Alternatively, the flow path spacer substrate 12 does not have to be provided and the head chip 10 may include the pressure chamber substrate 13 and the nozzle substrate 11. In this case, the individual discharge flow path can be formed including the groove provided in the surface on the nozzle substrate 11 side of the pressure chamber substrate 13, for example.

According to the present embodiment, the inkjet head 100 including the head chip 10 in the shear mode is described, but the present invention is not limited to the above. For example, the present invention can be applied to the inkjet head including the head chip in the vent mode, in which the piezoelectric element (pressure changer) fixed to the wall of the pressure chamber as the ink storage can be deformed to change the pressure on the ink in the pressure chamber to emit ink.

According to the embodiments and the modifications described above, the recording medium M is conveyed by the conveyor including the conveying belt 2*c*, but the present invention is not limited to the above. The conveyor 2 may hold the recording medium M on an outer circumferential surface of a rotating conveying drum to convey the recording medium M.

According to the embodiments and the modifications, the inkjet recording device 1 in a single pass method is used, but the present invention can be applied to the inkjet recording device which performs recording of the image while scanning with the inkjet head 100.

Various embodiments of the present invention are described, but the scope of the present invention is not limited to the above-described embodiments, and the present invention includes the scope defined by the attached claims and its equivalents.

INDUSTRIAL APPLICABILITY

The present invention can be used in an inkjet head and an inkjet recording device.

REFERENCE SIGNS LIST

1 inkjet recording device
2 conveyor
2*a*, 2*b* conveying roller
2*c* conveying belt
3 head unit
9 ink circulation mechanism
10 head chip
10*a* ink emitter
11 nozzle substrate
11*a* nozzle opening surface
111 nozzle
12 flow path spacer substrate
121 penetrating flow path
122*a* first precedent stage individual discharge flow path
122*b* second precedent stage individual discharge flow path
123 subsequent stage individual discharge flow path
124 individual discharge flow path
125 belt shaped penetrating flow path
13 pressure chamber substrate
131 pressure chamber
132 groove shaped flow path
133 vertical discharge flow path
134 dividing wall
135 connecting electrode
136 driving electrode
14 flow path substrate
141 channel
142 common discharge flow path
15 wiring substrate
151 ink supply opening
152 discharge hole
20 FPC
100 inkjet head
M recording medium

The invention claimed is:

1. An inkjet head comprising:

a plurality of ink emitters, each including, an ink storage which stores ink;

a pressure changer which changes pressure in the ink stored in the ink storage;

a nozzle which is connected to the ink storage and which emits ink according to a change in the pressure in the ink in the ink storage;

a plurality of precedent stage individual discharge flow paths which are connected to one ink storage and through which ink discharged without being supplied from the ink storage to the nozzle passes; and a subsequent stage individual discharge flow path to which the plurality of precedent stage individual discharge flow paths join, and a common discharge flow path which is connected to the plurality of subsequent stage individual discharge flow paths included in the plurality of ink emitters, and in which the ink which passes through the plurality of subsequent stage individual discharge flow paths flows;

wherein each of the plurality of precedent stage individual discharge flow paths has a length different from another precedent stage individual discharge flow path among the plurality of precedent stage individual discharge flow paths; and wherein the pressure loss for each unit of a length is small in the plurality of precedent stage individual discharge flow paths as the precedent stage individual discharge flow path becomes longer.

2. An inkjet head comprising:

a plurality of ink emitters, each including, an ink storage which stores ink;

a pressure changer which changes pressure in the ink stored in the ink storage;

a nozzle which is connected to the ink storage and which emits ink according to a change in the pressure in the ink in the ink storage;

a plurality of precedent stage individual discharge flow paths which are connected to one ink storage and through which ink discharged without being supplied from the ink storage to the nozzle passes; and a subsequent stage individual discharge flow path to which the plurality of precedent stage individual discharge flow paths join, and a common discharge flow path which is connected to the plurality of subsequent stage individual discharge flow paths included in the plurality of ink emitters, and in which the ink which passes through the plurality of subsequent stage individual discharge flow paths flows;

wherein the pressure loss of the ink in each of the plurality of precedent stage individual discharge flow paths is different from the pressure loss of the ink in another precedent stage individual discharge flow path among the plurality of precedent stage individual discharge flow paths.

3. An inkjet head comprising:

a plurality of ink emitters, each including, an ink storage which stores ink;

a pressure changer which changes pressure in the ink stored in the ink storage;

a nozzle which is connected to the ink storage and which emits ink according to a change in the pressure in the ink in the ink storage;

a plurality of precedent stage individual discharge flow paths which are connected to one ink storage and through which ink discharged without being supplied from the ink storage to the nozzle passes; and a subsequent stage individual discharge flow path to which the plurality of precedent stage individual discharge flow paths join, and a common discharge flow path which is connected to the plurality of subsequent stage individual discharge flow paths included in the plurality of ink emitters, and in which the ink which passes through the plurality of subsequent stage individual discharge flow paths flows;

wherein the pressure loss of the ink in the subsequent stage individual discharge flow path is larger than the pressure loss of the ink in the plurality of precedent stage individual discharge flow paths.

4. The inkjet head according to claim 3, wherein a minimum value of a cross-section area vertical in an ink discharge direction in the subsequent stage individual discharge flow path is equal to or more than a minimum value of a cross-section area vertical to an ink discharge direction in each of the plurality of precedent stage individual discharge flow paths.

5. An inkjet head comprising:

a plurality of ink emitters, each including, an ink storage which stores ink;

a pressure changer which changes pressure in the ink stored in the ink storage;

a nozzle which is connected to the ink storage and which emits ink according to a change in the pressure in the ink in the ink storage;

a plurality of precedent stage individual discharge flow paths which are connected to one ink storage and through which ink discharged without being supplied from the ink storage to the nozzle passes; and a subsequent stage individual discharge flow path to which the plurality of precedent stage individual discharge flow paths join, and a common discharge flow path which is connected to the plurality of subsequent stage individual discharge flow paths included in the plurality of ink emitters, and in which the ink which passes through the plurality of subsequent stage individual discharge flow paths flows, wherein each of the plurality of ink emitters include two precedent stage individual discharge flow paths, and the two precedent stage individual discharge flow paths are connected to the ink storage in a direction opposite to each other.

6. The inkjet head according to claim 1, wherein, each of the plurality of ink emitters include two precedent stage individual discharge flow paths, the plurality of nozzles included in the plurality of ink emitters are arranged along a predetermined direction, and regarding the two precedent stage individual discharge flow paths connected to each nozzle other than a nozzle at a predetermined end among the plurality of nozzles, only one of the precedent stage individual discharge flow paths passes between adjacent nozzles viewed from a side in an ink discharge direction from the nozzle.

7. An inkjet recording device including the inkjet head according to claim 1.

8. The inkjet head according to claim 3, wherein each of the plurality of ink emitters include two precedent stage individual discharge flow paths, and the two precedent stage individual discharge flow paths are connected to the ink storage in a direction opposite to each other.

9. The inkjet head according to claim 4, wherein each of the plurality of ink emitters include two precedent stage individual discharge flow paths, and the two precedent stage individual discharge flow paths are connected to the ink storage in a direction opposite to each other.

10. An inkjet recording device including the inkjet head according to claim 3.

11. An inkjet recording device including the inkjet head according to claim 4.

12. An inkjet recording device including the inkjet head according to claim 5.

* * * * *